US005441448A

United States Patent [19]

Yang

[11] Patent Number: 5,441,448

[45] Date of Patent: Aug. 15, 1995

[54] COIN COUNTING AND HOLDING DEVICE

[75] Inventor: John S. Yang, Northbrook, Ill.

[73] Assignee: Block and Company, Inc., Wheeling, Ill.

[21] Appl. No.: 134,525

[22] Filed: Oct. 8, 1993

[51] Int. Cl.[6] ..... G07D 9/06

[52] U.S. Cl. ..... 453/60; 453/62; 206/0.83

[58] Field of Search ..... 453/58, 59, 60, 61, 453/62; 206/0.8, 0.81, 0.82, 0.83, 0.84

[56] References Cited

U.S. PATENT DOCUMENTS

| | | | |
|---|---|---|---|
| 367,661 | 8/1887 | Porterfield | 453/60 |
| 1,095,256 | 5/1914 | Willis | 206/0.81 |
| 1,171,409 | 2/1916 | Bisland | 206/0.84 X |
| 1,198,204 | 9/1916 | Elmer | 453/49 |
| 1,280,031 | 9/1918 | Hinds et al. | 453/62 X |
| 1,289,840 | 12/1918 | Lukacher | 453/60 |
| 1,407,140 | 2/1922 | Friesen | 453/60 |
| 1,492,381 | 4/1924 | Lindenmayer | 453/54 |
| 1,618,390 | 2/1927 | Smith | 453/62 |
| 1,710,353 | 4/1929 | Donnellan | 453/59 X |
| 1,751,615 | 3/1930 | Bower | 206/0.83 X |
| 2,334,016 | 11/1943 | Loesch | 453/54 |
| 2,444,804 | 7/1948 | Carruthers | 453/62 X |
| 2,654,376 | 10/1953 | Hultberg | 453/54 |
| 2,829,777 | 4/1958 | Berardinelli | 453/54 X |
| 2,896,892 | 7/1959 | Berardinelli | 453/54 X |
| 3,265,077 | 8/1966 | Kirkpatrick | 453/62 X |
| 3,606,008 | 9/1971 | Lusetti | 206/0.84 |
| 3,675,664 | 7/1972 | Kitowski | 453/54 |
| 3,678,650 | 7/1972 | Green, Jr. | 453/62 X |
| 3,731,695 | 5/1973 | Maijer | 453/54 |
| 4,109,668 | 8/1978 | Malacheski | 453/59 |
| 4,495,959 | 1/1985 | Farber | 453/59 |
| 5,024,629 | 6/1991 | Murray | 453/54 |
| 5,026,321 | 6/1991 | Benson | 453/54 |

FOREIGN PATENT DOCUMENTS

| | | | |
|---|---|---|---|
| 59489 | 6/1913 | Germany | 453/60 |
| 555471 | 5/1958 | Italy | 453/62 |
| 618560 | 3/1961 | Italy | 453/62 |

OTHER PUBLICATIONS

PAP-R Products Physical Device Photographs.

MMF 1991 Fall-Winter Catalog List of Products, pp. 6 and 8-11.

Block Catalog No. 2591 A Frontspiece and pp. 14-17.

MMF Product No. 224-0004-00 Flyer.

*Primary Examiner*—Michael S. Huppert

*Assistant Examiner*—Scott L. Lowe

*Attorney, Agent, or Firm*—Wood, Phillips, VanSanten, Clark & Mortimer

[57] ABSTRACT

A device for counting, storing and stacking coins for filling standard coin wrappers is disclosed. A plurality of coin tubes is clustered in a parallel relationship. Each coin tube is a hollow cylindrical tube and receives and holds coins of a given denomination in a stack. Each tube has a bottom support surface and an open top. Each tube also includes a transverse slot perpendicular to the longitudinal axis of the coin tube. The transverse slot has a transverse bottom edge positioned so that a stack of coins between the bottom support surface of the tube and the transverse bottom edge of the transverse slot fills a standard coin wrapper for that denomination of coin. The transverse slot is dimensioned to allow extra coins stacked above the transverse bottom edge to slide out of the tube through the transverse slot. A plurality of coin keeper clips is insertable within the transverse slots to prevent coins from sliding out of the transverse slots. A plurality of funnels is also provided, one funnel being associated with the open top of each coin tube.

24 Claims, 3 Drawing Sheets

COIN COUNTING AND HOLDING DEVICE

BACKGROUND OF THE INVENTION

1. Field of the Invention

The present invention relates to a device for sorting, stacking, and storing different denominations of coins for counting and for filling standard coin wrappers.

2. Description of the Prior Art

There are devices available for sorting coins, for stacking coins, and for holding and storing sorted coins. There are devices available for filling standard tubular paper coin wrappers with stacked, counted coins.

However, the prior art devices are deficient in several respects. First, many do not provide a simple, physical means, other than visual inspection, to ensure that the proper volume of coins is present prior to filling a coin wrapper, and do not provide such a simple means in a device that stacks coins of various denominations and that leaves the other stacks of coins undisturbed. Nor do such prior art devices allow for the combination of easy sweeping of different denominations of coins into an appropriate funnel from a table or counter top with a simple physical means of determining that the proper volume of coins of each denomination is present.

SUMMARY OF THE INVENTION

It is an object of the present invention to provide a single device that allows for sorting and storage of coins of different denominations.

It is a further object of the present invention to provide such a device that allows for sliding coins off of a flat surface into an appropriate receptacle within the device.

It is a further object of the present invention to provide such a device that eases the burden of filling standard tubular paper coin wrappers.

It is a further object of the present invention to provide such a device that simplifies stacking the proper number of coins for filling standard tubular paper coin wrappers.

It is a further object of the present invention to provide such a device that stores stacks of coins until placed in standard coin wrappers.

It is a further object of the present invention to provide such a device that provides a simple, physical means of ensuring that the appropriate volume of coins is present before filling a coin wrapper with the stack of coins.

It is a further object of the present invention to provide such a device that provides a simple, physical means of ensuring that the appropriate volume of coins of one denomination is present while not disturbing other stacks of coins stored in the device.

The present invention meets these and other objects by providing a device for counting, stacking and storing coins and for filling standard tubular paper coin wrappers. A plurality of coin tubes is clustered in a parallel relationship, each coin tube comprising a hollow cylindrical tube having a diameter sized to receive and hold coins of a given denomination in a stack and having a length sized to receive and hold a predetermined number of stacked coins. Each tube has a bottom support surface and an open top. Each tube also includes a transverse slot perpendicular to the longitudinal centerline of the coin tube. The transverse slot has a transverse bottom edge positioned so that a stack of coins between the bottom support surface of the tube and the transverse bottom edge of the transverse slot fills a standard coin wrapper for that denomination of coin. The transverse slot is dimensioned to allow extra coins stacked above the transverse bottom edge to slide out of the tube through the transverse slot. A plurality of coin keeper clips is insertable within the transverse slots to prevent coins from sliding out of the transverse slots. A plurality of funnels is also provided, one funnel being associated with the open top of each coin tube.

In another aspect, the present invention provides a device for counting, stacking and storing a plurality of denominations of coins and for filling standard tubular coin wrappers. The device comprises a base housing having corners with a transverse slot at each corner. A top is integral with and at one end of the base housing. The top has side edges meeting at corners, dividing walls and top sections. The dividing walls extend to the corners of the side edges, the dividing walls and the side edges dividing the top into the top sections. Each top section defines a funnel leading to an open end of an elongate cylindrical opening. Each elongate cylindrical opening extends from its open end into the base housing at one of the corners of the base housing. Each elongate cylindrical opening has a diameter sized to receive and hold coins of a given denomination in a stack, one transverse slot being in communication with each elongate cylindrical opening. A bottom support surface within each elongate cylindrical opening in the base housing supports the stack of coins in that cylindrical opening. The distance between the bottom support surface and transverse slot for each elongate cylindrical opening corresponds with a predetermined number of coins of that denomination.

DETAILED DESCRIPTION OF THE ILLUSTRATED EMBODIMENT

Figure 1:
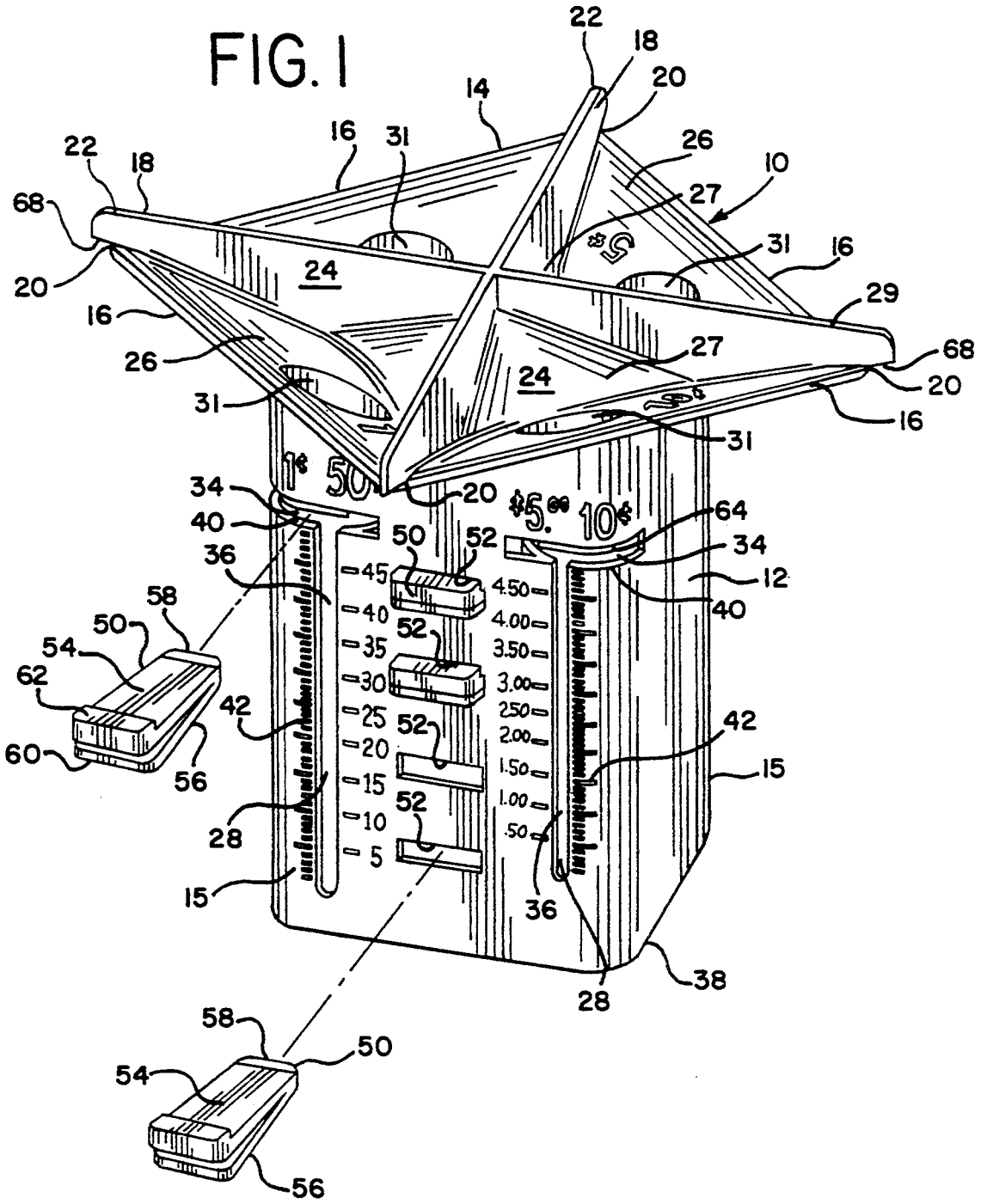
FIG. 1 is a perspective view of the device of the present invention.
Figure 2:
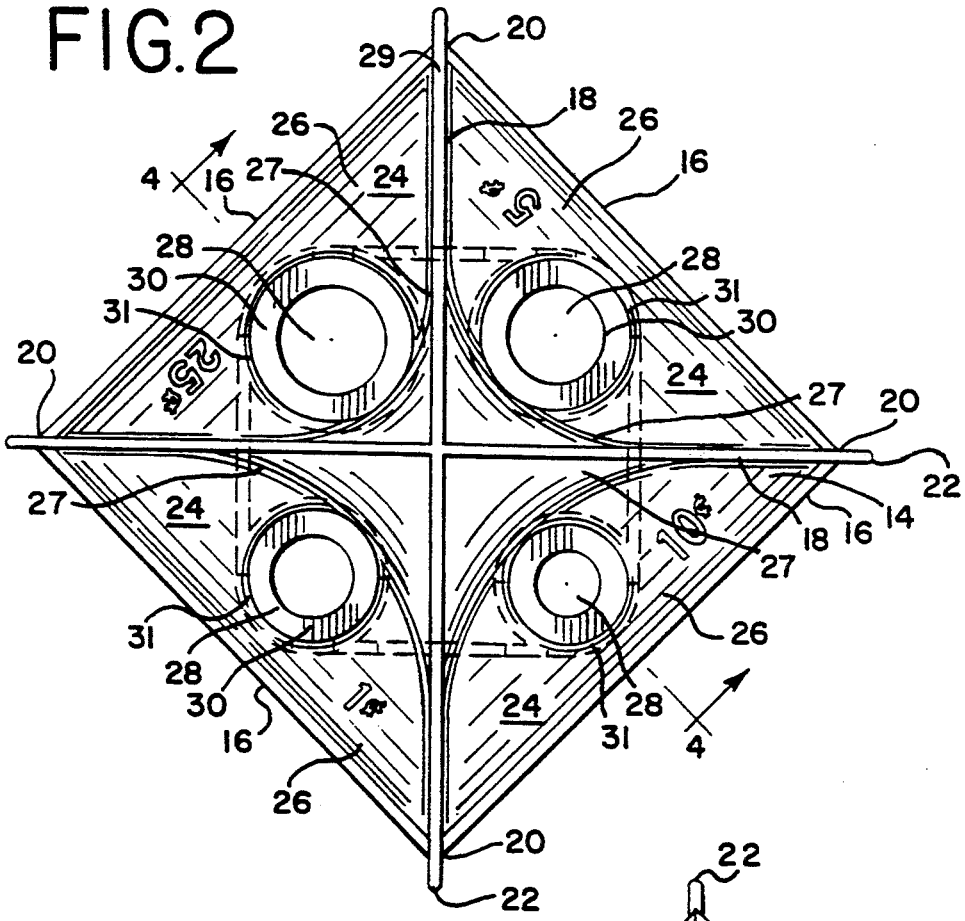
FIG. 2 is a top view of the device of FIG. 1.
Figure 3:
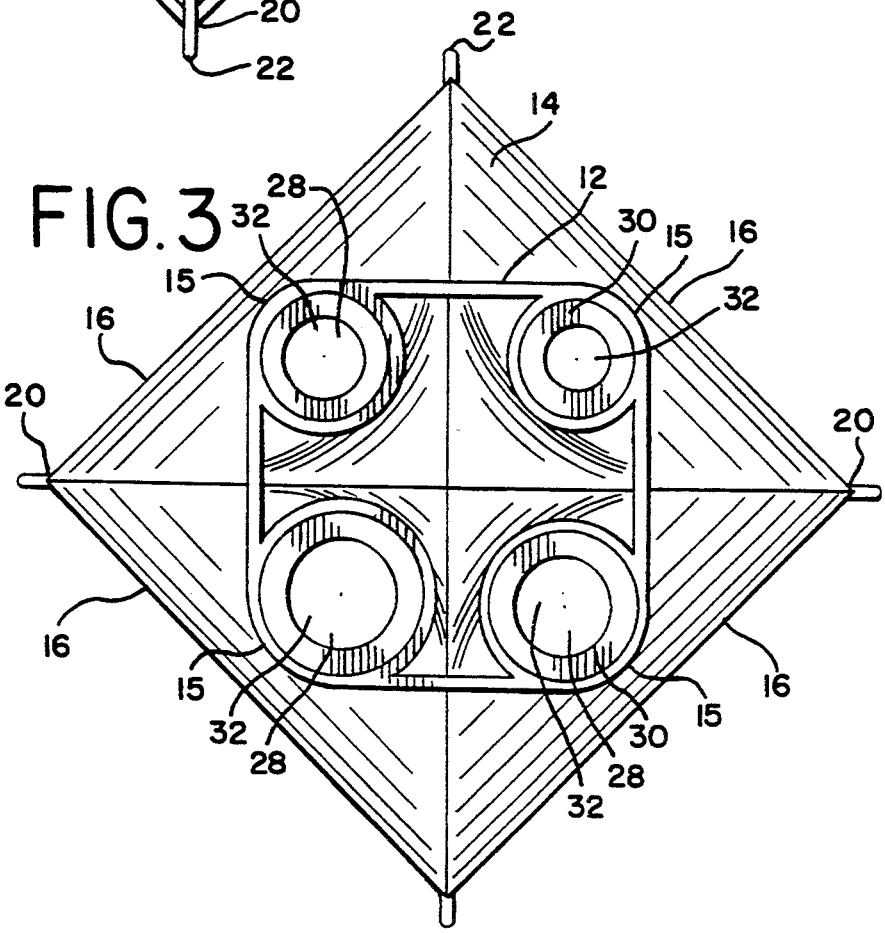
FIG. 3 is a bottom view of the device of FIG. 1.
Figure 4:
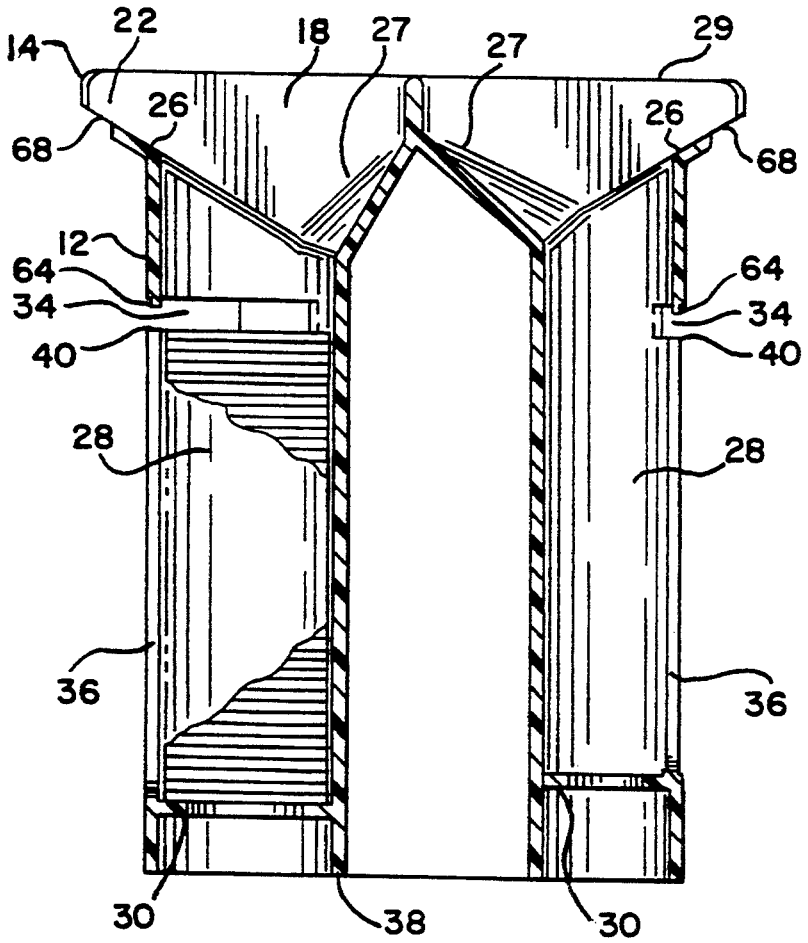
FIG. 4 is a cross-section, taken along line 4—4 of FIG. 2 with coins partially removed for clarity of illustration.

As shown in FIG. 1, the present invention provides a device 10 for counting, stacking and storing a plurality of denominations of coin and for filling standard tubular paper coin wrappers. The device 10 comprises a base housing 12 substantially square in cross section, as shown in FIG. 3. The base housing 12 has four rounded corners 15 and a substantially square top 14 integral with and at one end of the base housing 12.

The top 14 has four side edges 16 and a pair of orthogonal dividing walls 18 extending between the four corners 20 of the top 14 to ends 22. The square top 14 is at an angle of about forty-five degrees with respect to the base 12. Thus, the four corners 20, defined by the intersections of the side edges 16, and the ends 22 of the dividing walls are disposed midway between the four rounded corners 15 of the base housing 12.

The dividing walls 18 and the side edges 16 define the perimeters of four top funnel sections 24. Within each top funnel section 24, a flat wall 26 slopes downwardly from the side edge 16 toward the center of the square top 14 at an angle of about thirty degrees. From the corners 20 of the top, the flat wall intersects with the dividing walls 18 on both sides. A curved wall 27 diverges downwardly from an apex at the intersection of the dividing walls 18, along substantially straight lines of intersection with the dividing walls 18, to meet the flat wall 26 along a curved line of intersection. The apex is spaced below the top edge 29 of the dividing walls 18. The two ends of the curved line of intersection meet the intersections of the dividing walls 18 and the flat wall 26, along straight lines of intersection.

Within the flat wall 26, an elongate cylindrical opening 28, or coin tube, has an open top end 31. The curved line of intersection is at the interior edge of each coin tube opening. The walls 18, 26, 27 and open top end 31 of each coin tube 28 define a funnel through which coins may be fed into the coin tube 28.

Each elongate cylindrical opening, or coin tube 28 has a diameter sized to receive and hold coins of a given denomination in a stack. In the illustrated embodiment, the device 10 has four coin tubes 28, one each for quarters, dimes, nickels and pennies, and the diameter of each coin tube is slightly greater than the diameter of the denomination of coin to be stored, so that a coin wrapper can be slipped partway down the coin tube around the stacked coins, or to assist in adjusting the coin stack in the tube. The four coin tubes 28 are clustered in a parallel relationship in the base housing 12.

Each coin tube 28 has a bottom support surface 30, spaced from the open top of the tube. In the illustrated embodiment, the bottom support surface 30 of each coin tube is annular, with an open inner diameter 32. The open inner diameter 32 is less than the diameter of the coins to be stored, and less than the diameter of the coin tube. Thus, a stack of coins is supported on the surface 30, but a finger tip or pointed object may be inserted through the open inner diameter to assist in pushing the stacked coins into a tubular coin wrapper.

Each coin tube 28 also has two slots: a transverse slot 34 and a longitudinal slot 36. As illustrated in FIG. 1, there are four transverse slots 34, each at the same level on the base housing, that is, each transverse slot 34 is equidistant from the flat bottom 38 of the base housing 12. In the illustrated embodiment, the transverse slots 34 are at each rounded corner 15 of the base housing 12, and they are perpendicular to the longitudinal axes of the coin tubes.

Each transverse slot 34 has a transverse bottom edge 40 positioned so that a stack of coins between the bottom support surface 30 and the transverse bottom edge 40 fills a standard coin wrapper for that denomination of coin. Extra coins, that is, beyond that amount needed to fill a standard coin wrapper, are thus above the transverse bottom edge 40. The transverse slot 34 is large enough so that these extra coins may slide though the slot when the device is tipped at an angle. Thus, the proper number of coins may be obtained in each coin tube by tipping the device at an angle of, for example, twenty degrees, allowing the excess coins in the tube to slide out through the transverse slot 34.

To allow a visual inspection and sight check on the count and orientation of the coins in each coin tube, the longitudinal slots 36 are provided on each coin tube. The longitudinal slots 36 extend parallel to the longitudinal axes of the coin tubes, and extend from near the bottom support surface 30 to the associated transverse slot 34, so that the two slots in combination form a T-shaped slot. Each longitudinal slot is narrow and is in communication with each elongate opening, or coin tube 28, but is dimensioned to prevent the coins from sliding out through the slot 36. Scales, or indicators, 42 are provided along both sides of each longitudinal slot 36, indicating both the number of coins and the dollar value of the coins corresponding with the level of the stack of coins in the tube.

The device of the present invention may also be used as a bank for collecting and storing the various denominations of coin until placing them in coin wrappers. To prevent the coins in a tube from spilling out of the tube when the device is tipped, as for example, when removing excess coins from another tube, a plurality of coin keeper clips 50 are provided. As shown in FIG. 1, the base housing 12 has a set of four clip storage slots 52 between adjacent coin tubes on one face of the base housing; the clips 50 may be stored in these storage slots 52 when not in use.

Figure 5:
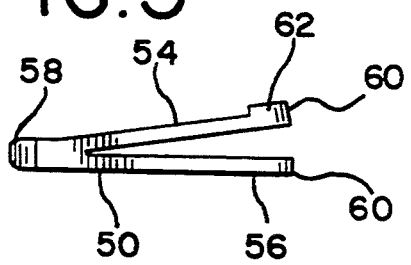
FIG. 5 is a side view of a coin keeper clip of the present invention.

As shown in FIG. 5, each coin keeper clip 50 has resilient integral upper 54 and lower 56 arms connected at an elbow 58. Each arm 54, 56 has a free end 60, and the upper arm 54 is biased away from the lower arm 56. In the illustrated embodiment, the free end 60 of the upper arm 54 has an upstanding abutment 62. The combined widths of the free ends 60 and upstanding abutment 62 is greater than the height of each clip storage slot 52 to prevent the clips from being pushed too far into the clip slots.

To keep coins from sliding or falling out of the coin tubes, a coin keeper clip 50 may be inserted into a transverse slot 34. The clips are sized to essentially block the transverse slot and open end of the coin tube, thereby keeping the coins within the tubes. The transverse slots 34 in the illustrated embodiment have downwardly depending abutments 64. The combined widths of the free ends 60 and upstanding abutments 62 is greater than the distance between the downwardly depending abutments 64 and transverse bottom edges 40 to prevent the clips 50 from being pushed into the coin tubes 28.

In the illustrated embodiment, the elbow 58 of each coin keeper clip 50 is rounded, and the upper 54 and lower 56 arms are substantially equal in length. The lengths of the upper 54 and lower 56 arms are greater than the diameter of the largest coin tube 28.

Another advantage of the device of the present invention is that it allows for coins to be fed into the proper coin tube by sliding the coins from a table or counter top into the funnel 24. For this function, the square top 14 of the device is larger than the clustered coin tubes. The width of the square top, between any two opposite side edges 16, is greater than the width and diagonal dimension of the base housing 12, and greater than the greatest diagonal distance between opposite coin tubes 28.

Any of the funnels 24 may be supported on the edge of a table or counter top, with one of the side edges 16 of the top 14 flush against the edge of the table or counter top. To support the device in this position, the dividing walls 18 have ends 22 which extend above and beyond the junctures of the side edges 16. In the illustrated embodiment, the ends 22 of the dividing walls have angled shoulders 68, so that the device 10 may be supported at an angle with respect to the table or counter top. So placed, coins of a particular denomination may then be pushed into the appropriate funnel, and if the coins are pushed in a steady manner, they should stack automatically in the appropriate coin tube.

The top edges 29 of the dividing walls 18 are co-planar, and the side edges 16 of the top are between the top edges 29 and the transverse slots 34. The dividing walls 18 are high enough to prevent coins from easily slipping from one funnel 24 to another.

Once a coin tube for a given denomination has been filled with a stack of coins, the user may visually inspect the coin stack through the longitudinal slot 36, and compare the number shown on the scale 42 with the appropriate number of coins for a coin wrapper. If there are too many coins, the clips 50 may be placed in the three other transverse slots 34, and the device tipped to allow excess coins to slide out through the open transverse slot 34. Once it is determined that the appropriate number of coins are present, the user may then take a standard tubular paper coin wrapper and slide the wrapper down the vertical column of coins approximately three-quarters of the length of the column of coins. The user may then place a finger in the open end of the wrapper, at the funnel end, and turn the device over. By sliding the finger down the wrapper, the remaining coins in the stack will then fill the wrapper, and the wrapped stack may be removed and sealed. Throughout this operation, the clips 50 keep other coins from falling out of their coin tubes.

The device may be made as a single molded unit. As shown in FIG. 3, the square top 14, base housing 12 and coin tubes 28 are molded as a unit, with the four rounded corners 15 of the base housing forming portions of the coin tubes 28. The positions of the bottom support surfaces 30 for each coin tube varies with respect to the flat bottom 38 of the base housing, to allow for the transverse slots 34 to be at the same level for each denomination of coin.

Although the invention has been disclosed and described in its preferred form with a certain degree of particularity, it is understood that the present disclosure of the preferred form is only by way of example and that numerous changes in the details of operation and in the combination and arrangement of parts may be made without departing from the spirit and scope of the invention as hereinafter claimed.

I claim:

1. A device for counting, stacking, and storing coins and for filing standard tubular coin wrappers, the device comprising:

a plurality of coin tubes clustered in a parallel relationship within a substantially square base housing, each coin tube comprising a hollow cylindrical tube having a diameter sized to receive and hold coins of a given denomination in a stack and having a length sized to receive and hold a predetermined number of stacked coins, each tube having a bottom support surface and an open top;

each tube including a transverse slot perpendicular to the longitudinal axis of the coin tube, the transverse slot having a transverse bottom edge positioned so that a stack of coins between the bottom support surface of the tube and the transverse bottom edge of the transverse slot fills a standard coin wrapper for that denomination of coin, the transverse slot being dimensioned to allow extra coins stacked above the transverse bottom edge to slide out of the tube through the transverse slot;

a plurality of funnels, one funnel being associated with the open top of each coin tube; and a substantially square top located over said base housing, said top having an area significantly greater than the area of the cross-section of said base housing and positioned at an angle of about forty-five degrees with respect to the orientation of said base housing, said funnels being formed in said top.

2. A device as claimed in claim 1 wherein the bottom support surface of each tube is annular and has an open inner diameter smaller than the diameter of the tube.

3. A device as claimed in claim 1 further comprising a longitudinal slot associated with each coin tube to provide visual access to the interior of the coin tube, each longitudinal slot extending from one end near the bottom support surface of the tube to an opposite end at the transverse slot.

4. A device for counting, stacking, and storing coins and for filling standard tubular coin wrappers, the device comprising:

a plurality of coin tubes clustered in a parallel relationship, each coin tube comprising a hollow cylindrical tube having a diameter sized to receive and hold coins of a given denomination in a stack and having a length sized to receive and hold a predetermined number of stacked coins, each tube having bottom support surface and an open top;

each tube including a transverse slot perpendicular to the longitudinal axis of the coin tube, the transverse slot having a transverse bottom edge positioned so that a stack of coins between the bottom support surface of the tube and the transverse bottom edge of the transverse slot fills a standard coin wrapper for that denomination of coin, the transverse slot being dimensioned to allow extra coins stacked above the transverse bottom edge to slide out of the tube through the transverse slot; and a base housing substantially square in cross-section, one coin tube being disposed at each corner of the base housing, the transverse slots being disposed at each corner of the housing; and a plurality of funnels, one funnel being associated with the open top of each coin tube.

5. A device as claimed in claim 4 further comprising a substantially square top on the base housing, the top having a pair of orthogonal dividing walls, four side edges and four sections, the dividing walls extending between the four corners of the top and intersecting at the center of the top to divide the top into the four sections, each section of the top defining one of the funnels.

6. A device as claimed in claim 5 wherein the width of the top is greater than the diagonal dimension of the base housing.

7. A device as claimed in claim 5 wherein the dividing walls have ends extending beyond the substantially square top.

8. A device for counting, stacking, and storing coins and for filling standard tubular coin wrappers, the device comprising:

a plurality of coin tubes clustered in a parallel relationship, each coin tube comprising a hollow cylindrical tube having a diameter sized to receive and hold coins of a given denomination in a stack and having a length sized to receive and hold a predetermined number of stacked coins, each tube having bottom support surface and an open top;

each tube including a transverse slot perpendicular to the longitudinal axis of the coin tube, the transverse slot having a transverse bottom edge positioned so that a stack of coins between the bottom support surface of the tube and the transverse bottom edge of the transverse slot fills a standard coin wrapper for that denomination of coin, the transverse slot being dimensioned to allow extra coins stacked above the transverse bottom edge to slide out of the tube through the transverse slot; and a coin keeper clip insertable with one of the transverse slots to prevent coins from sliding out of the transverse slot; and a plurality of funnels, one funnel being associated with the open top of each coin tube.

9. A device as claimed in claim 8 wherein the coin keeper clip comprises resilient integral upper and lower arms connected at an elbow and having free ends, the upper arm being biased away from the lower arm.

10. A device as claimed in claim 9 wherein the elbow has a rounded edge and wherein the upper and lower arms are substantially equal in length, the lengths of the upper and lower arms being greater than the diameter of the largest coin tube.

11. A device as claimed in claim 9 further comprising a base housing holding the coin tubes, wherein the base housing includes a storage slot separate from the coin tubes to receive and store the coin keeper clip.

12. A device as claimed in claim 11 wherein the upper arm of the coin keeper clip has an upstanding abutment at its free end, the combined dimension of the free ends of the upper and lower arms being greater than the height of the storage slot.

13. A device for counting, stacking and storing a plurality of denominations of coins and for filling standard tubular coin wrappers, the device comprising:

a base housing having corners, with a transverse slot at each of the corners of the base housing;

a top integral with and at one end of the base housing, the top having side edges meeting at corners, dividing walls and top sections, the dividing walls extending to the corners where the side edges of the top meet, the dividing walls and the side edges dividing the top into the top sections;

each top section defining a funnel leading to an open end of an elongate cylindrical opening, each elongate cylindrical opening extending from its open end into the base housing at one of the corners of the base housing, each elongate cylindrical opening having a diameter sized to receive and hold coins of a given denomination in a stack, one transverse slot being in communication with each elongate cylindrical opening; and a bottom support surface within each elongate cylindrical opening in the base housing to support the stack of coins in that cylindrical opening, the distance between the bottom support surface and transverse slot for each elongate cylindrical opening corresponding with a predetermined number of coins of that denomination.

14. A device as claimed in claim 13 wherein said dividing walls have top edges, and wherein the side edges are below the top edges between the top edges and the transverse slots in the elongate cylindrical openings.

15. A device as claimed in claim 13 wherein the ends of the dividing walls extend beyond and above the corners where the side edges of the top meet.

16. A device as claimed in claim 13 wherein there are opposite side edges and the distance between opposite side edges is greater than the distance between opposite corners of the base housing.

17. A device as claimed in claim 13 wherein the corners where the side edges of the top meet are located between the corners of the base housing.

18. A device as claimed in claim 13 wherein the base housing has a flat bottom and the transverse slots are equidistant from the flat bottom of the base housing.

19. A device as claimed in claim 13 wherein the dividing walls have co-planar top edges.

20. A device as claimed in claim 13 further comprising a plurality of coin keeper clips insertable within the transverse slots and wherein the base housing includes a plurality of storage slots for holding the coin keeper clips when not in use.

21. A device as claimed in claim 13 wherein the base housing has one longitudinal slot in communication with each elongate cylindrical opening, each longitudinal slot extending from near the bottom support surface of each elongate cylindrical opening to the transverse slot associated with that elongate cylindrical opening.

22. A device as claimed in claim 21 further comprising indicators positioned alongside each longitudinal slot.

23. A device as claimed in claim 13 wherein the base housing has four rounded corners, with an elongate cylindrical opening at each corner of the base housing, and the top is substantially square, with four side edges and the dividing walls comprise a pair of intersecting orthogonal walls dividing the top into four funnel sections.

24. A device as claimed in claim 23 including a curved wall and a flat wall in each top funnel section, the flat wall sloping downwardly from the side edge toward the center of the top, the open end of the elongate cylindrical opening being in the flat wall, the flat wall intersecting with the dividing walls and with the curved wall, the curved wall having an apex at the intersection of the dividing walls and diverging downwardly toward the open end from the apex.

* * * * *